US006701999B2

(12) United States Patent
Von Wyl et al.

(10) Patent No.: US 6,701,999 B2
(45) Date of Patent: Mar. 9, 2004

(54) METHOD AND DEVICE FOR PRODUCING SLABS OF STEEL

(75) Inventors: Horst Von Wyl, Duisburg (DE); Ingo Schubert, Krefeld (DE)

(73) Assignee: Mannesmann AG, Düsseldorf (DE)

( * ) Notice: Subject to any disclaimer, the term of this patent is extended or adjusted under 35 U.S.C. 154(b) by 0 days.

(21) Appl. No.: 09/423,482

(22) PCT Filed: Apr. 27, 1998

(86) PCT No.: PCT/DE98/01198

§ 371 (c)(1),
(2), (4) Date: Nov. 8, 1999

(87) PCT Pub. No.: WO98/50185

PCT Pub. Date: Nov. 12, 1998

(65) Prior Publication Data

US 2003/0145976 A1 Aug. 7, 2003

(30) Foreign Application Priority Data

May 7, 1997 (DE) ..... 197 20 768

(51) Int. Cl.[7] ..... B22D 11/12; B22D 11/04

(52) U.S. Cl. ..... 164/484; 164/478; 164/416; 164/454; 164/154.1

(58) Field of Search ..... 164/452, 454, 164/413, 154.1, 484, 442, 441, 478, 416

(56) References Cited

U.S. PATENT DOCUMENTS 3,891,025 A * 6/1975 Bollig et al. ..... 164/154
4,030,533 A * 6/1977 Itoh et al. ..... 164/147
4,953,614 A * 9/1990 Lemper ..... 164/416
5,152,334 A * 10/1992 Gallucci ..... 164/484
5,488,987 A * 2/1996 Di Giusto et al. ..... 164/452
5,771,957 A * 6/1998 Von Wyl et al. ..... 164/416
5,853,043 A * 12/1998 Takeuchi et al. ..... 164/476
5,941,299 A * 8/1999 Striuli et al. ..... 164/452
6,044,895 A * 4/2000 Kuttner et al. ..... 164/155.4
6,102,101 A * 8/2000 Hanazaki et al. ..... 164/452

* cited by examiner

*Primary Examiner*—M. Alexandra Elve
*Assistant Examiner*—Len Tran
(74) *Attorney, Agent, or Firm*—Cohen, Pontani, Lieberman & Pavane

(57) ABSTRACT

A a process for producing slabs from steel, in which the strand leaves a permanent mold with liquid melt enclosed by the strand shell and, in a downstream strand guiding assembly, the gap between guide rollers mounted in stands is set infinitely variably by adjusting elements connecting lower and upper frames, characterized by the following steps:

a) the gap(s) is changed by an oscillation about a predeteminable center line (c) of the gap in such a way that the dynamic influences on the guide rollers are negligible, and no plastic deformation of the strand shell occurs;

b) the current gap (s) is recorded, c) at the same time, the actuating force (F) of the adjusting elements and the amplitude (A) of the actuating force are determined, and d) with increasing amplitude (A) of the actuating force (F), the gap (s) is set to a predeterminable value and/or is pressure-controlled by at least one adjusting element.

8 Claims, 5 Drawing Sheets

METHOD AND DEVICE FOR PRODUCING SLABS OF STEEL

PRIORITY CLAIM

This is a U.S. national stage of application No. PCT/DE98/01198, filed on Apr. 27, 1998. Priority is claimed on that application:

Country: Germany, Application No: 197 20 768.5, Filed: May 7, 1997.

BACKGROUND OF THE INVENTION

1. Field of the Invention

The invention relates to a process for producing slabs from steel, in which the strand leaves a permanent mold with liquid melt enclosed by the strand shell and, in a downstream strand guiding assembly, the gap between guide rollers mounted in stands is set infinitely variably by adjusting elements connecting lower and upper frames, and relates to an associated apparatus for this.

2. Discussion of the Prior Art

DE 26 12 094 C2 discloses an apparatus for changing the distance between parts of a frame or stand of a strand guiding assembly lying opposite one another in pairs and connected by tie rods, in which bushes which can be turned with the aid of pressure cylinders are provided. The movable frame parts are connected by pressure cylinders, exchangeable spacers being insertable between the movable frame part and the inner bushes for the purpose of setting a pre-determinable roller spacing. In this embodiment, an infinitely variable setting of the spacing between the guide rollers can also be carried out.

In a disadvantageous way, the adjustment of the gap by the turning of the bushes is possible only over a very limited distance. In addition, considerable mechanical wear must be expected during the adjusting operation. With these known hydraulic clamping cylinders, it is not possible for the clamping force to be deduced, since part of the clamping force is absorbed by the so-called spacers.

U.S. Pat. No. 3,891,025 discloses continuous casting stands which are hydraulically adjustable and the gap of which is recorded by position sensors and a servo unit can be set.

The essential object of the subject matter of this patent is merely to apply adequate pressing force, or set the gap, for transporting the strand.

DE-A-24 44 443 discloses a process for continuously casting a steel melt in which the change in thickness of the casting is determined and compared with a specific reference value, in order in this way to control the drawing rate and/or the amount of secondary cooling water.

Practice has shown that such a method of detecting the lowest point of the liquid crater can be used only in the case of a geometrically ideal installation and a quite specific casting rate and cooling. In the hostile conditions of a metallurgical plant, however, an installation cannot be set up exactly with respect to the gap, or else thermal deformations occur in the segments or the installation operates in an inexact way, with the consequence that the changes in thickness determined are subject to considerable variations, in particular in the region of the lowest point of the liquid crater.

SUMMARY OF THE INVENTION

Cognizant of the difficulties mentioned above, the object of the invention is to provide a process and an apparatus with which the gap can be set exactly over the entire strand guiding assembly by simple means and, in addition, the current position of the lowest point of the liquid crater within the slab can be determined. Furthermore, while being of a simple construction, the apparatus is to be capable of reliably guiding the cold strand.

According to the invention, the gap is changed by an oscillation about a predeterminable center line of the slab thickness aimed for. In this case, an oscillation value which keeps to a negligible level the dynamic influences on the strand shell, which is still relatively thin after leaving the mold, is chosen. The amplitude of the oscillating gap is set to a value which prevents plastic deformation of the strand shell.

The current value of the gap is recorded by means of distance measuring elements and is fed to a computer. At the same time, the actuating force of the adjusting elements for the infinitely variable changing of the gap is determined and likewise fed to the computer. By means of a computing program, the amplitude is monitored and, when the amplitude of the actuating force increases, the gap is set to a pre-determinable value and/or the gap between the guide rollers is pressure-controlled by means of one of the adjusting elements setting the gap in an infinitely variable manner.

The amplitude of the actuating force is in this case a measure of the degree of solidifying of the strand. That is to say, a relatively small amplitude of the actuating force is encountered when the strand shell is still thin and there is a large liquid crater. The amplitude reaches its greatest value when the strand is solidified through.

Consequently, recording the amplitude of the actuating force provides a reliable measure for recording the current position of the lowest point of the liquid crater and carrying out a dynamic soft reduction.

The computer also establishes a relationship between the gap and the actuating force. It has been found in this case that, if the gap deviates from its optimum value, the following situation arises:

- if the gap is smaller than the optimum, the edge pressure of the slab increases, with the consequence that the actuating force increases
- if the gap is larger than the optimum, no edge pressure occurs and the strand bulges, the actuating force assuming a lower overall value.

In the case of quasi-static measurement, in first approximation this can be represented by two simple curves $F_1$ and $F_2$, which represents overall the form of an angle with two sides. At the optimum gap, the optimum pressure distribution over this strand shell and the liquid crater enclosed by it is also to be encountered.

Recording the current actuating force allows the optimum gap to be set by detecting from the oscillation whether the trend away from the optimum gap is toward the larger or smaller gap, in order then to take specific measures to counteract this.

In the case of dynamic measurement, the actuating force F behaves with respect to the gap s in the form of a hysteresis curve. The deformation work of a segment during the stroke, i.e. the area within the hysteresis curve, can be calculated by evaluation software and the strand consistency can be deduced. The hysteresis curve has a relatively small area overall when the shell is still thin and the crater is relatively large. The hysteresis curve has a relatively large area when the shell is continuing to grow and the crater volume is decreasing. The hysteresis assumes a particularly slender form when the strand has solidified right through.

The invention achieves an optimization of the production performance from qualitative and quantitative aspects, to be precise with respect to qualitative optimization by a soft reduction which is always carried out optimally (seen locally, dynamic soft reduction) and with respect to quantitative optimization of the production performance by the possibility of being able to maximize utilization of the machine length, with high operational reliability at the same time.

Moreover, if displacement-controlled hydraulics are used, no further mechanical components are required.

In addition, any so-called thermal tracking software there may be is considerably improved in its accuracy.

BRIEF DESCRIPTION OF THE DRAWINGS

An example of the invention is represented in the attached drawing, in which.

DETAILED DESCRIPTION OF THE PREFERRED EMBODIMENTS

Figure 1:
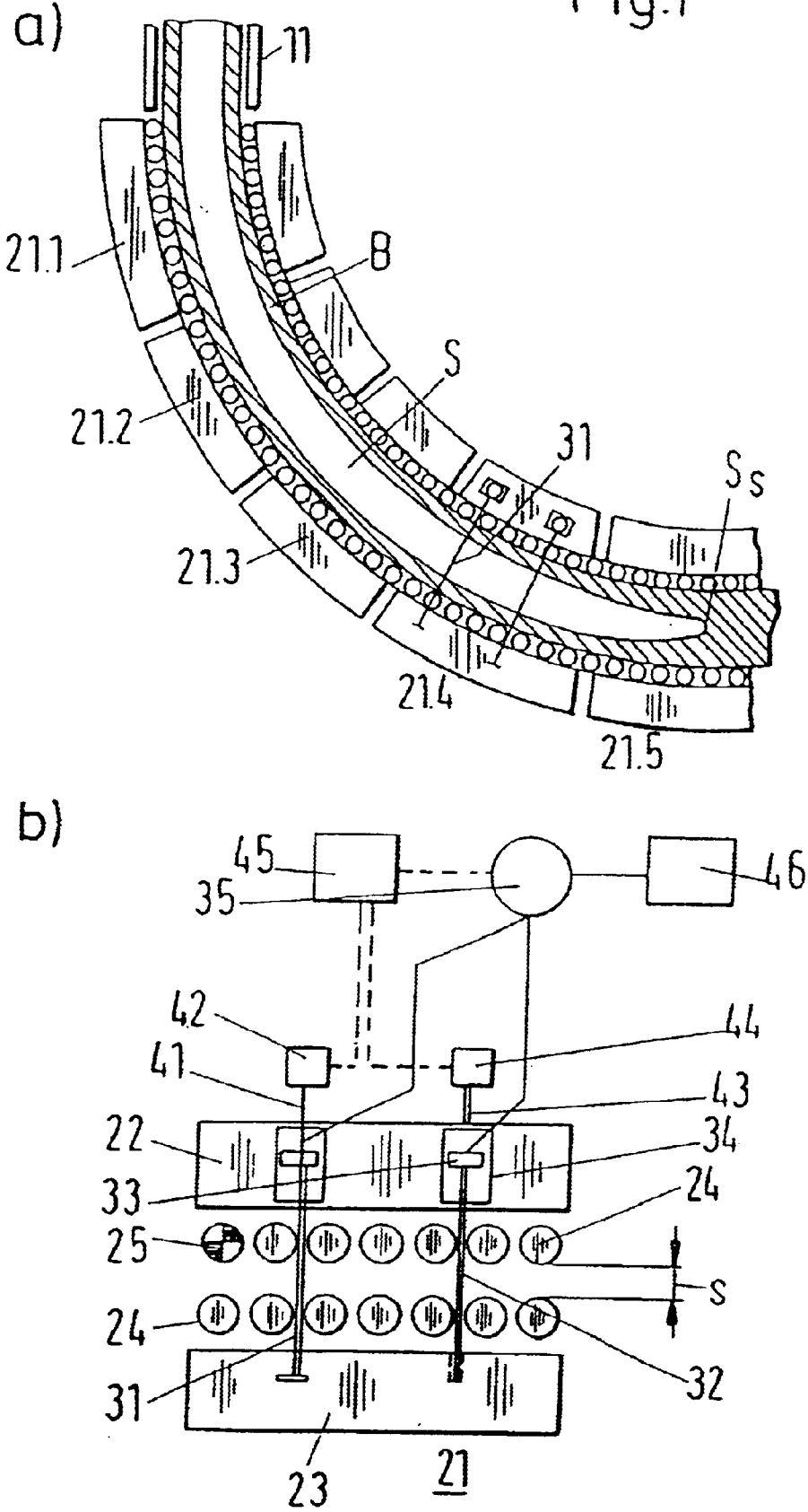
FIG. 1 shows the diagram of the continuous casting installation.

FIG. 1 shows, in the upper part of the image, the diagram of a continuous casting installation with a permanent mold 11, at the mouth of which a slab B emerges and is guided by stands 21.1 to 21.5. In the slab, the strand shell of which gradually solidifies, there is a crater S up to a lowest point $S_s$. For the sake of simplicity, adjusting elements 31 are represented only in the case of the stand 21.4.

Presented in FIG. 1*b* is the diagram of a stand 21, which has an upper frame 22 and a lower frame 23, which determine by means of adjusting elements 31 the gap between the guide rollers 24 arranged on them. One of the guide rollers is a drive roller 25, the function of which will be described in further detail in FIG. 5.

The adjusting elements have a tie rod 32, which as a rule is fastened in the lower frame 23 and has at its opposite end a piston 33, which is guided in a cylinder 34. The individual stands 21 have at least four adjusting elements 31, the cylinders 34 of which are in connection with an actuator 35.

In the left-hand part of the diagram, the adjusting element 31 is equipped with a distance-measuring element 41, which is in connection with a distance-measuring pick-up 42, which is connected in terms of measuring technology to a computer 45.

In the right-hand part of the diagram, the cylinder 34 is equipped with a pressure-measuring element 43, which is connected to a pressure pick-up 44, which is likewise connected in terms of measuring technology to the computer 45. The computer 45 cooperates in control terms with the actuator 35.

In addition, the actuator is connected to an oscillator 46.

Figure 2:
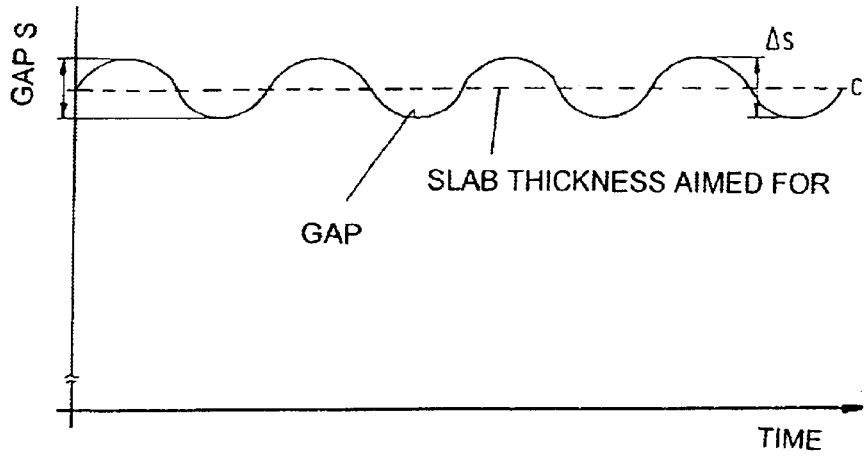
FIG. 2 shows the dependence of the gap or the actuating force over time.
Figure 2:
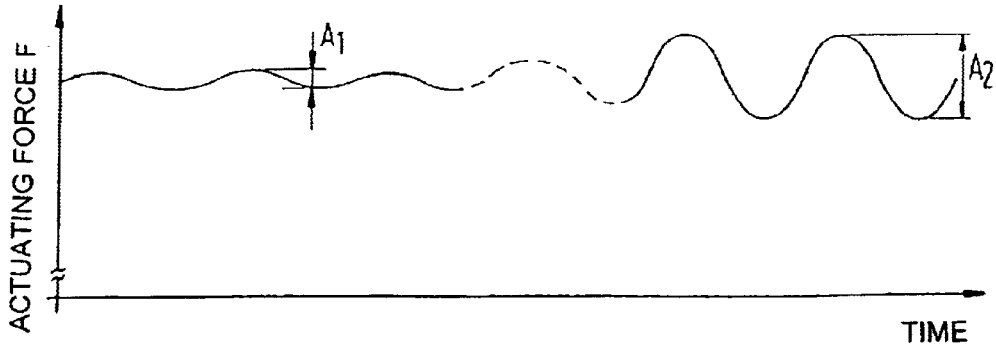

In FIG. 2, in the upper part of the image, the gap is plotted over time. By means of an oscillator, the gap "s" is changed by the slab thickness aimed (center line c). In the present case, it is a sinusoidal oscillation. The frequency (f) of the gap oscillation is 0.05 to 5.0 Hertz. However, other modes of oscillation are also possible and envisaged.

In the lower part of the image, the actuating force F is plotted over time. In the left-hand part of the image, the actuating force has a relatively small amplitude. In the right-hand part, the amplitude of the actuating force has increased distinctly.

Figure 3:
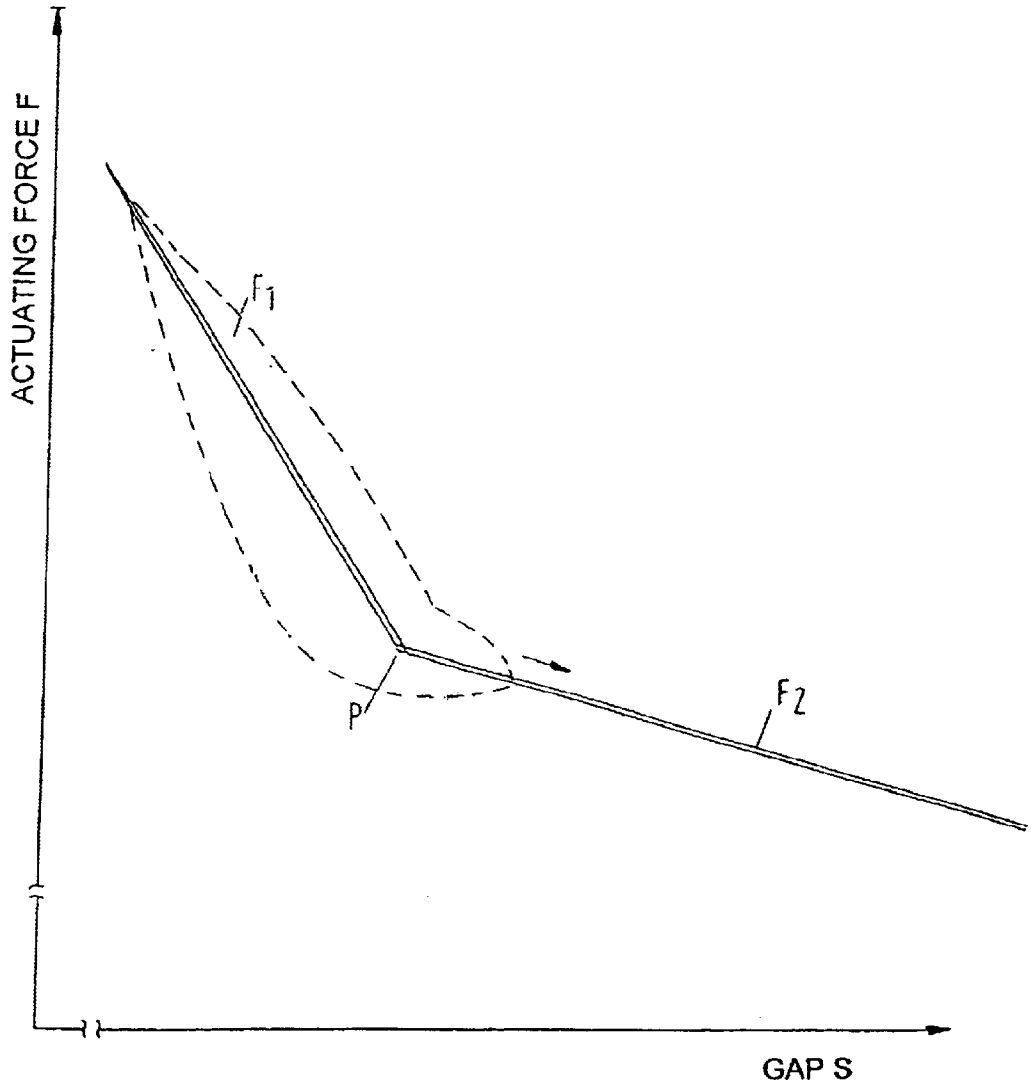
FIG. 3 shows the dependence of the actuating force over the gap.

In FIG. 3, the dependence of the actuating force over the gap is represented (F=f(s)). It is evident that, in first approximation, two curves, or in the greatest simplification two straight lines, to be precise $F_1=a-m_1 \cdot s$ and $F_2=b-m_2 \cdot s$, can be represented by means of a computer. Since the two curves have different slopes, they intersect at a point P.

In a further approximation, the actuating force relation F/gap s shows a hysteresis which has substantially the form of an angle with two sides, with an apex point P. The optimum gap is expected in the region of the point.

Should it become evident in the evaluation during operation that the hysteresis curve is migrating along one side $F_1$ or $F_2$, measures are to be taken to the effect that both sides are of approximately the same size and that their point of intersection and the break point of the hysteresis are in the region of the point P, in other words close to the optimum of the gap.

Should the image evaluation show that the hysteresis no longer has a break point and consequently has migrated out along one side of the angle $F_1$ or $F_2$, measures are to be taken in the form and direction of the gap in order that the hysteresis is as uniform as possible on both sides of the point P.

Figure 4:
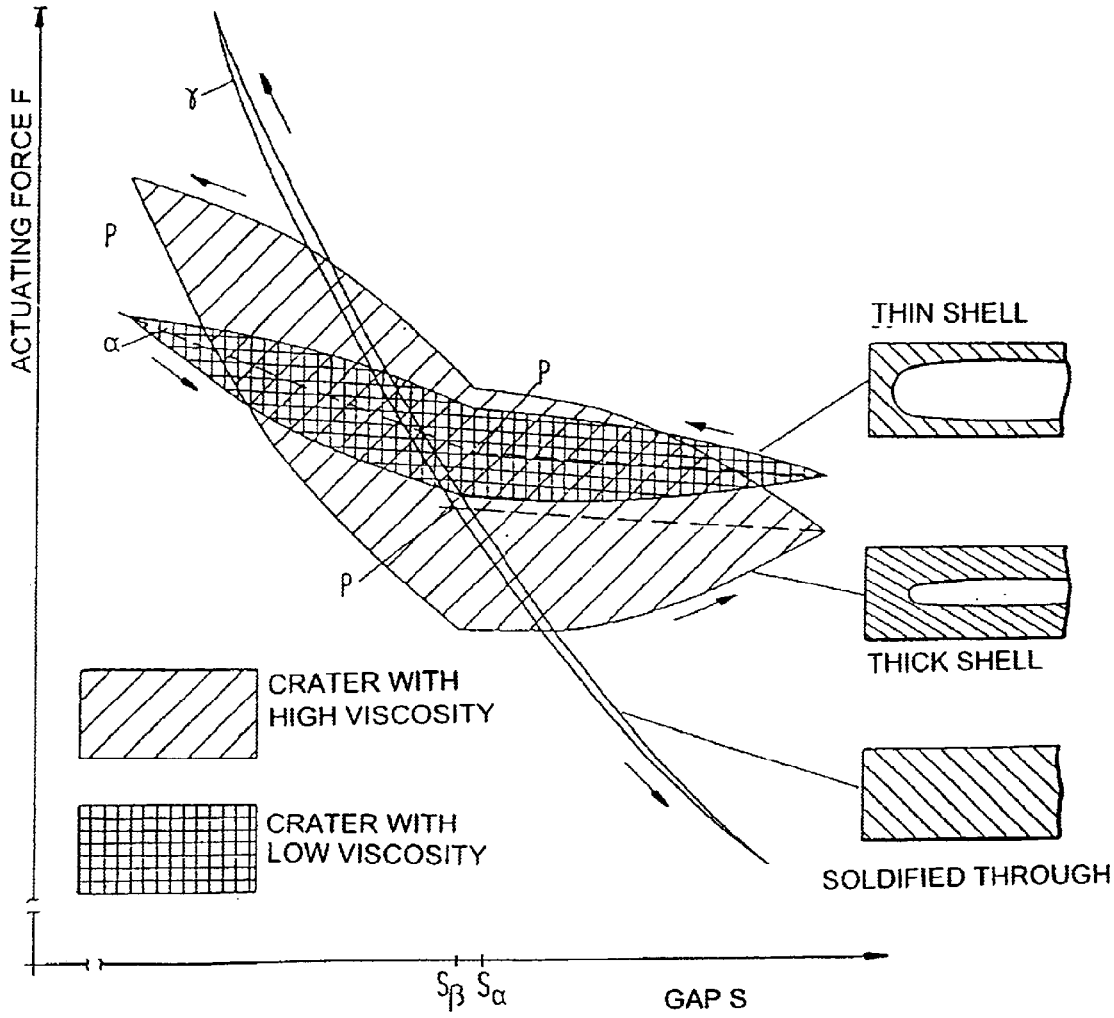
FIG. 4 shows the formation of the hysteresis.

In FIG. 4, the dependence of the actuating force over the gap has been refined even further. In dependence of the size of the crater, the hysteresis develops from type $\alpha$ through type $\beta$ to solidified-through type $\gamma$.

Thus, the crater of type $\alpha$ has a thin shell with a crater of low viscosity, type $\beta$ has a distinctly thicker shell and at the same time a crater with high viscosity and type $\gamma$ has altogether solidified through.

The image representations presented here show a uniform distribution for the hystereses and consequently the optimum gap, either $s_\alpha$ or else $s_\beta$.

The actual forms of the hystereses detectable during operation consequently allow the deviation from the optimum gap to be detected and the correct measures to be adapted in dependence on the degree and direction of the adjustment of the gap. Furthermore, conclusions can be drawn as to the degree of solidification.

Figure 5:
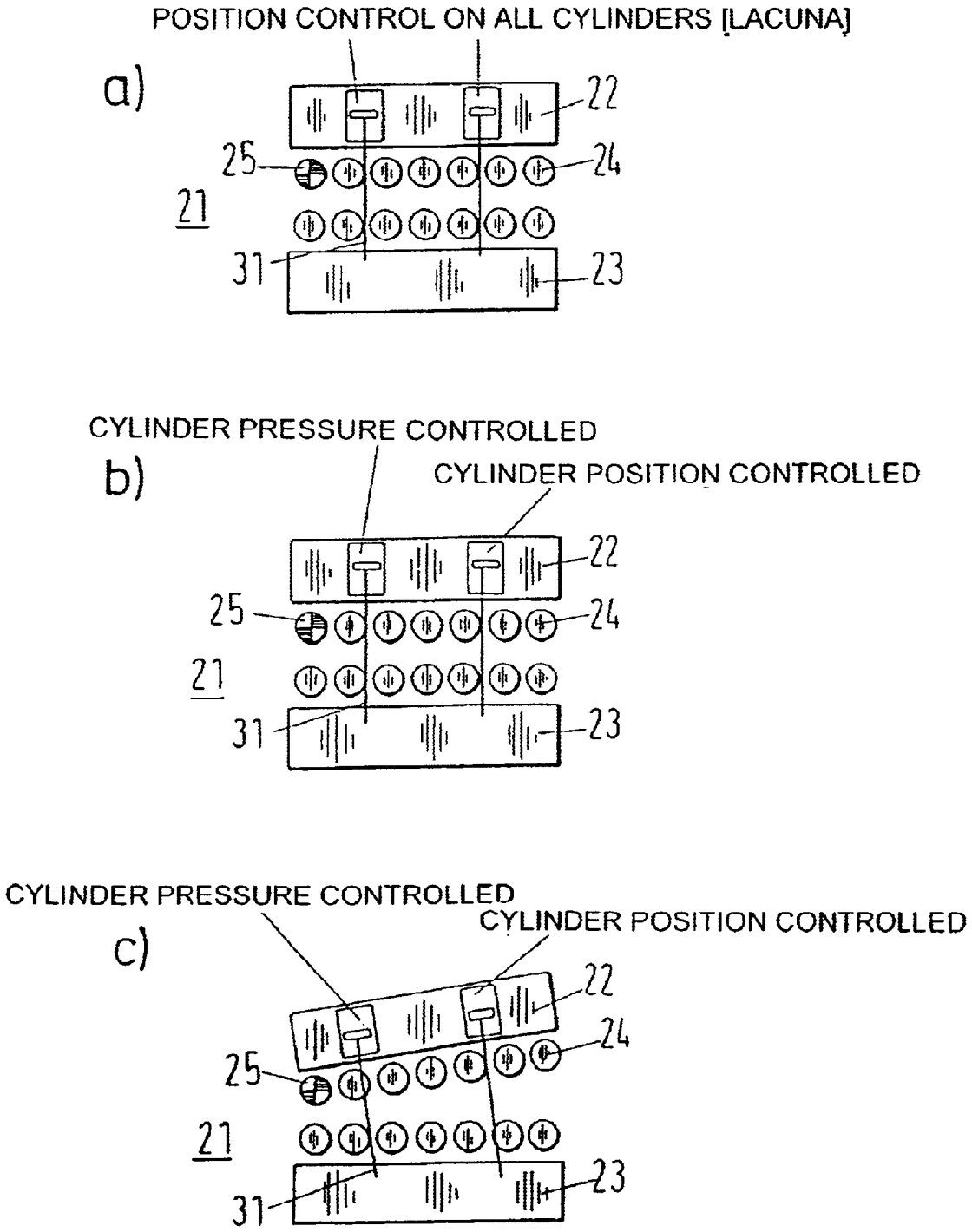
FIG. 5 shows stands in various operating states.

FIG. 5 shows a stand in three different operating states. The item numbers correspond to those already presented in the images above. In FIG. 5*a* the image is normal casting operation, in which a position control is carried out on all cylinders. In the present example, a drivable guide roller is provided at the stand inlet on the upper frame.

In FIG. 5*b*, operation when the strand has solidified through is represented. Here, the cylinders for the adjusting elements arranged in the region of the drivable guide roller are pressure-controlled and the cylinders represented downstream with respect to the strand are position-controlled.

In FIG. 5*c*, for transporting the cold strand, the upper frame of the stand is inclined in such a way that the drive roller has direct contact with the cold strand by means of the adjusting elements arranged in the vicinity of said roller, by pressure control of the cylinders, and the cylinders of the adjusting elements which are arranged away from the drive roller are position-controlled. In this case, their position is set such that during the transport of the cold strand they do not have any contact with the latter.

What is claimed is:

1. A process for producing a slab from steel, in which a strand leaves a permanent mold with liquid melt surrounded by a strand shell and, in a downstream strand guiding assembly, a gap between guide rollers mounted in strands is set infinitely variably by adjusting elements which connect lower and upper frames, the process comprising the steps of:

a) continously changing the gap (s) by oscillating the size of the gap about a predeterminable center line of the gap while the strand is drawn out of the mold so that dynamic influences on the guide rollers are negligible and no plastic deformation of the strand shell occurs;

b) recording the current gap(s);

c) simultaneously determining an actuating force (F) of the adjusting elements and a magnitude (A) of the force from which strand shell strength is determinable; and d) with increasing magnitude of the actuating force (F), at least one of setting the gap (s) to a predeterminable value and pressure-controlling the gap by means of at least one adjusting element, whereby when the gap is larger the force on the strand is smaller and when the gap is smaller the force on the strand is larger.

2. A process according to claim 1, wherein the gap (s) is oscillated at a frequency (f) in a rage of 0.05 to 5.0 Hertz, inclusive.

3. A process according to claim 1, including recording the current actuating force in a computer aided manner and preprocessing the actuating force (F) in such a way that, in a first approximation, the actuating force (F) behaves in dependence on the actual gap (s) based on two curves:

$$F_1=a-m_1 \cdot s$$

$$F_2=b-m_2 \cdot s,$$

which have the form of an angle which two sides of different slope, with an apex point (P), and setting the gap (s) following the relationship F=f(s) so that proportions of the sides $F_1$ and $F_2$ are kept substantially at an equal size.

4. A process according to claim 3, wherein the one side $F_1=a-m_1 \cdot s$ corresponds to a gap which is smaller and the second side $F_2=b-m_2 \cdot s$ corresponds to a gap which is larger than an optimum gap (s) at the apex point (P), a degree and direction of the adjustment of the gap (s), being adapted as a function of the relationship F=f(s).

5. A process according to claim 3, wherein a variation of the actuating force (F) has, in a second approximation, the form of a hysteresis, an extent of the actuating force (F) with respect to an associated gap (s) is used as a measure of viscosity of the liquid crater in the slab and, in dependence on the viscosity found, conclusions are drawn as to a position of a lowest point of the liquid crater and gap adjustment is adapted.

6. A continuous casting installation for producing slabs from steel, comprising:

a permanent mold;

a downstream strand guiding assembly, which has stands with lower and upper frames on which there are provided guide rollers having a gap therebetween which is infinitely variable by adjusting elements connecting the frames;

distance sensors provided for determining the gap between the guide rollers;

a computer connected to the distance sensors;

an actuator connected to the computer and operatively connected to the adjusting elements so that the adjusting elements are operated in at one of a pressure- and a distance-controllable manner for gap setting, whereby when the gap is large the force on the strand is smaller and when the gap is smaller the force on the strand is larger; and an oscillator provided so as to induce the adjusting elements to undergo oscillation outside a resonant vibration with respect to the strand stands.

7. A continuous casting installation according to claim 6, wherein the distance sensor have measuring elements which are connected directly to the adjusting element.

8. A continou casting installation according to claim 7, wherein the adjusting elements are hydraulic and have a piston, the element being connected to the piston.

* * * * *